United States Patent [19]

Petralia

[11] Patent Number: 4,823,429

[45] Date of Patent: Apr. 25, 1989

[54] VACUUM CLEANER

[75] Inventor: Salvatore Petralia, Sayreville, N.J.

[73] Assignee: The Regina Co., Inc., Rahway, N.J.

[21] Appl. No.: 185,659

[22] Filed: Apr. 25, 1988

[51] Int. Cl.[4] ..... A47L 5/28; A47L 5/34

[52] U.S. Cl. ..... 15/333; 15/361

[58] Field of Search ..... 15/333, 361, 354, 355

[56] References Cited

U.S. PATENT DOCUMENTS

| | | | |
|---|---|---|---|
| 824,733 | 7/1906 | Merrick et al. | 16/33 |
| 1,678,111 | 7/1928 | Frantz | 15/361 |
| 2,104,453 | 1/1938 | Dow | 15/354 |
| 2,485,363 | 10/1949 | Coss | 15/358 |
| 2,664,587 | 1/1954 | Kitto | 15/333 |
| 3,512,207 | 5/1970 | Ettridge | 15/361 |
| 3,579,699 | 5/1971 | Balzer | 15/361 |
| 4,217,674 | 8/1980 | Hayashi et al. | 15/361 |
| 4,446,594 | 5/1984 | Watanabe et al. | 15/323 |
| 4,686,736 | 8/1987 | Petralia | 15/332 |

FOREIGN PATENT DOCUMENTS

| | | | |
|---|---|---|---|
| 481828 | 3/1952 | Canada | 15/333 |
| 936951 | 12/1955 | German Democratic Rep. | 15/361 |

*Primary Examiner*—Chris K. Moore

*Attorney, Agent, or Firm*—Martin LuKacher

[57] ABSTRACT

A low cost mechanism for disengaging the brush which agitates the surface over which the vacuum cleaner nozzle moves by lifting the portion of the nozzle having the brush mounted therein above the surface. The lift mechanism is reciprocably mounted in the nozzle housing rearwardly of the brush and extends outwardly from the nozzle housing to lift the forward end of the housing which contains the brush by pivoting the housing about the rear wheels. The lift mechanism is implemented by a stanchion having posts with upper ends extending from a bar. The bar has a trough facing the surface over which the cleaner moves. A roller having a width about at least one-third the width of the nozzle housing is journaled in the trough and extends out of the base. The roller is mounted with its axis generally paralleling the axis of rotation of the brush. The stanchion is also located adjacent to the body or canister portion of the vacuum cleaner for engagement with a surface at the bottom of the body. The body is pivotally mounted in the nozzle housing and pivots from a rearward floor cleaning position to an upright above the floor cleaning position. Then the surface of the bottom engages the upper ends of the stanchion posts and reciprocates the stanchion to bring the base and roller out through the bottom of the nozzle housing thereby causing forward end of the housing and the brush to lift off the surface.

10 Claims, 3 Drawing Sheets

VACUUM CLEANER

DESCRIPTION

Figure 1:
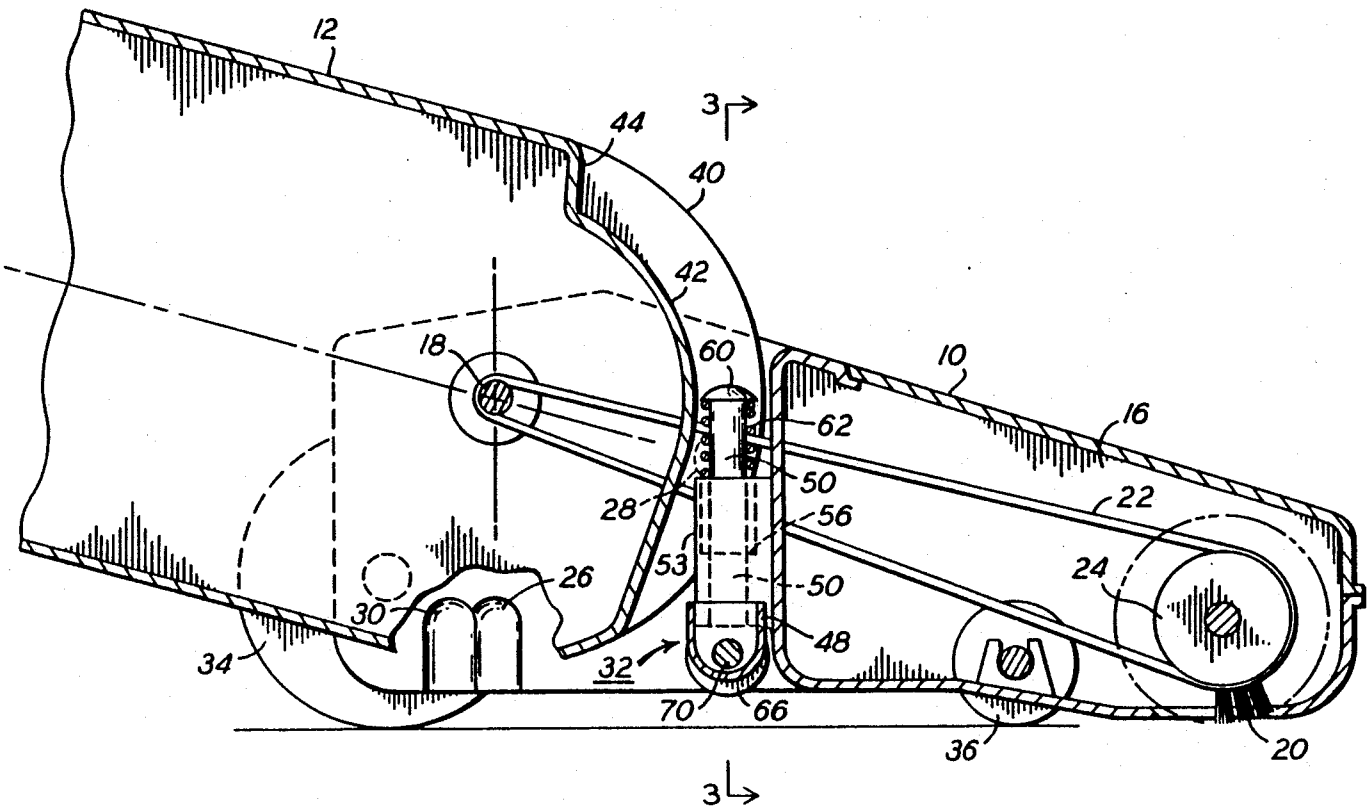

The present invention relates to vacuum cleaners and particularly to an improved mechanism for lifting the floor agitation brush of a vacuum cleaner so as to disengage it from the floor.

The invention is especially suitable for use in vacuum cleaners having the combined features of upright and canister vacuum cleaners and may be known as convertible vacuum cleaners which function as an upright cleaner for floor cleaning and as a canistser vacuum cleaner for above the floor cleaning.

A convertible vacuum cleaner in which the invention may be used is described in U.S. Pat. No. 4,686,736 issued Aug. 18, 1987 to S. Petralia et al. It is advantageous in a convertible vacuum cleaner to relieve the load on the motor which drives both the brush and the fan to create the vacuum when the vacuum cleaner is placed in its above the floor or canister mode of operation. The Petralia et al. patent discloses an improved mechanism for decoupling the brush from the motor. Another approach is to raise the brush off the floor and the Petralia et al. patent mentions the following U.S. patents in this regard: Brace U.S. Pat. No. 2,763,883 issued Sept. 25, 1956; Hayashi et al. U.S. Pat. No. 4,217,674 issued Aug. 19, 1980 and Watanabe et al. U.S. Pat. No. 4,446,594 issued May 8, 1984. Other U.S. patents showing various types of lift off mechanisms are Merrick U.S. Pat. No. 824,733 issued July 3, 1906; Frantz, U.S. Pat. No. 1,678,111 issued July 24, 1928; Dow, U.S. Pat. No. 2,104,453 issued Jan. 4, 1938; Coss, U.S. Pat. No. 2,485,363 issued Oct. 18, 1949; Ettridge, U.S. Pat. No. 3,512,207 issued May 19, 1970 and Kitto, U.S. Pat. No. 2,664,587 issued Jan. 5, 1954. Another vacuum cleaner lift off mechanism is shown in German patent No. 936 951 of Dec. 22, 1955.

The above described mechanisms require complex linkages, toggles, cams or eccentrics.

It is the principal object of the invention to provide an improved lift off mechanism for a vacuum cleaner agitating brush which may readily be fabricated and incorporated in a vacuum cleaner at low cost, with a minimum of parts and without the complexities of prior lift off mechanisms.

It is a further object of the invention to Provide an improved mechanism for lifting the forward end of a nozzle containing an agitator brush sufficiently to bring the brush out of engagement with the surface to be cleaned and which serves to stabilize the vacuum cleaner while it is being used in an above the floor or canister mode of operation.

Briefly described, the improved lift off mechanism emboding the invention is mounted in a nozzle housing in which the brush is also mounted The mechanism has as its principal part a stanchion having a base of length at least about half the width of the nozzle housing and which preferably has a trough in which a roller of at least about one-third the width of the nozzle housing is journaled. The stanchion had two upright posts which project to upper ends through openings in mounting brackets attached to the nozzle housing. The body of the vacuum is pivotally mounted at the bottom thereof in the nozzle housing and presents surfaces which engage the upper ends of the stanchion posts when the body is tilted forwardly to a position to place the cleaner in the above the floor mode of operation There the motor which drives the brush and also drives the fan which creates the vacuum is turned on. The upper ends of the stanchion posts are engaged and extend the stanchion through the bottom of the nozzle housing thereby causing the housing to pivot about its rear end where wheels may be located. The forward end of the nozzle housing and the brush is then raised sufficiently to bring the brush out of contact with the surface (the rug or floor) to be cleaned. Detents may be located in the body and in the nozzle housing for latching the body in upright position for above the floor cleaning. When the vacuum cleaner is used for floor cleaning the body is tilted rearwardly and the stanchion is allowed to retract into the nozzle housing Springs around the posts may be used to bias the stanchion to its retracted position.

Figure 2:
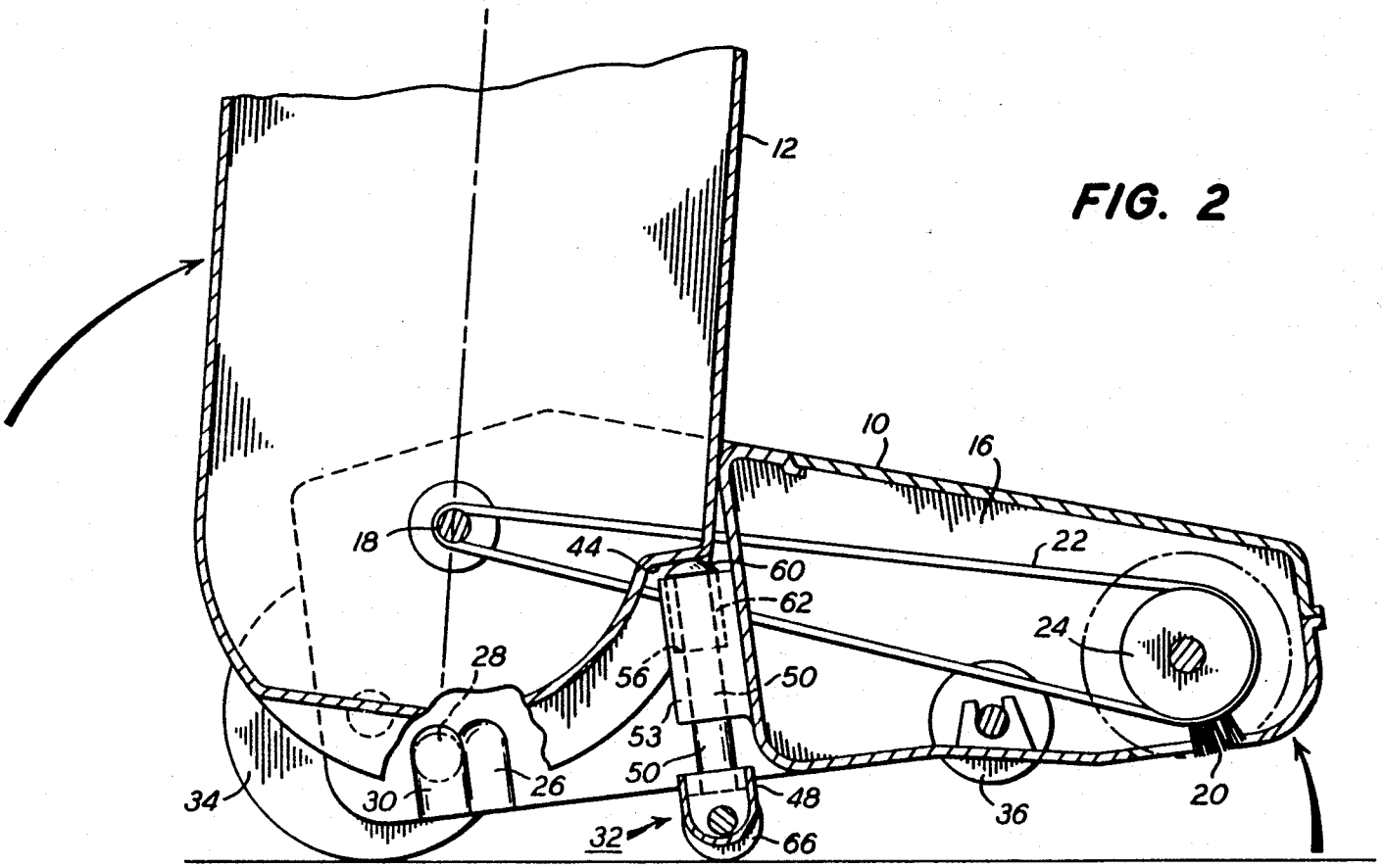
Figure 3:
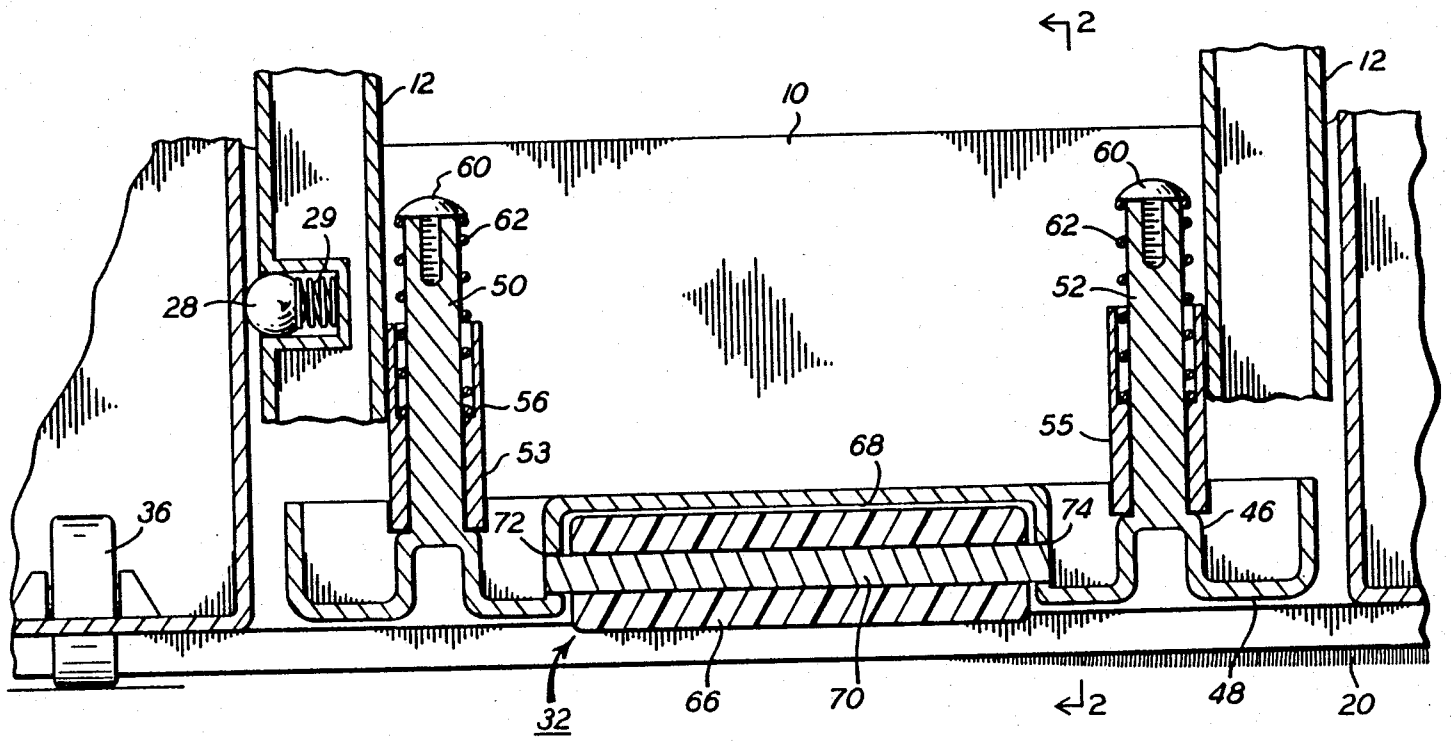

The foregoing and other objects, features and advantages of the invention as well as a presently preferred embodiment thereof will become more apparent from a reading of the following description in connection with the accompanying drawings in which:

FIGS. 1 and 2 are simplified sectional views illustrating a vacuum cleaner having a lift off mechanism emboding the invention in its floor cleaning and above the floor cleaning modes respectively; and FIG. 3 is a sectional view taken along the line 3—3 in FIG. 1 and showing the stanchion of the lift off mechanism.

Referring more particularly to the drawings there is shown a nozzle housing 10 and a body or canister 12 from the top of which there projects a handle (not shown). The nozzle housing 10 and body 12 constitute a convertible vacuum cleaner which is generally of the design shown in the above referenced Petralia et al. U.S. Pat. No. 4,686,736. As shown more particularly in that patent, the body 12 is pivotally mounted on trunions in the rearward portion of the nozzle housing 10. The bottom of the body contains the motor which drives the fan for creating the vacuum which is communicated to a chamber 16 in the forward part of the nozzle housing 10 when a wand is connected to that housing as shown and described more particularly in the Petralia et al. patent. A shaft 18 extends from one end of the motor and drives a brush 20 which is journaled in the forward end of the nozzle housing 10 using a belt 22 and a pulley 24. The brush is driven continuously while the motor is running.

The body is pivoted to a forward position as shown in FIG. 2 which is slightly past vertical. A ball 28 enters the notches 26 and another more rearwardly disposed notch 30. This ball is biased by a spring 29 and serves as a latch to hold the body either in its upright or to a more forwardly disposed position, as shown in FIG. 2 for above the floor cleaning, when the body is rocked rearwardly as shown in FIG. 1, the vacuum cleaner is in its floor cleaning mode. However, when in the forward upright position as shown in FIG. 2 as to enable the above the floor cleaning mode. Then a lift mechanism 32 is operated so as to lift the brush 20 above the floor. This relieves the load on the motor, since the brush is not in contact with the floor. The motor can then run faster and develop greater suction which is desirable for above the floor cleaning.

The vacuum cleaner is movable over the floor on rear wheels 34 which are journaled in wells in the lower rear end of the nozzle housing 10. Another pair of wheels 36, which are optional, may be provided. These wheels rest on the ground during the floor cleaning mode as shown in FIG. 1.

The bottom end 40 of the body 12 is generally hemi-cylindrical and has a pair of notches, the inner surfaces 42 of which extend to a flat portion 44 which actuates the lift mechanism 32 when the cleaner is in the above the floor cleaning position as shown in FIG. 2. The lift mechanism is provided by a stanchion 46 having a base 48 and a pair of upright posts 50 and 52. The base is at least one-half the width of the nozzle housing 16 (the width being measured in the direction of the axis of rotation 50 of the brush 20). In a preferred embodiment of the invention the width of the nozzle is approximately 12 inches while the base 48 is approximately 6¾ inches long. The axis of the posts may be approximately 4¾ inches apart.

Mounting means for the posts are provided by brackets 53 and 55 which extend into the notches in the bottom of the body 12. Each of these brackets has a hole of greater diameter than the diameter of the posts 50 and 52. The upper portion of the holes may be of greater diameter than the lower portion and define a step 56. The upper end of the posts 50 and 52 have enlarged heads 60 which may be provided by screws which are screwed into the posts and capture helical compression springs 62 between the steps 56 and the heads 60. These springs bias the lift mechanism inwardly of the nozzle housing and raise the bottom of the lift mechanism above the level established by the wheels 34 and 36. The springs are optional and may be dispensed with if desired. The lower end of the base 48 desirably has a generally hemi-cylindrical shape in cross section and may be continuous throughout its length. In a preferred embodiment of the invention, as shown in the drawing, a roller 66 of length approximately one-third the width of the nozzle is located in a trough 68 in the bottom of the base 48. A pin 70 on which the roller 66 is journaled is extended through an captured in holes 72 and 74 at the opposite ends of the trough 68. The hole 76 through which the pin 70 extends is desirably tapered so as to center the roller.

The taper extends from larger diameters near the ends of the roller to a smaller diameter at the center of the roller. The stanchion 46 is desirably molded by injection molding from plastic, such as polycarbonate or PMS so as to have sufficient strength to prevent the pins from breaking off as they reciprocate. Reciprocation of the pins is obtained since they are located in the notches for engagement with the end portion 44 of the bottom surface 42 of the notches. Accordingly, when the body 12 is rocked forwardly to the position shown in FIG. 1, the lift mechanism 32 extends to an engages the floor. This pivots the forward end of the nozzle housing 10 upwardly.

The roller 66 and the rear wheels provide a stable and sturdy support for the vacuum cleaner. Since the roller 66 is journaled on the pin 72 the vacuum cleaner may readily be moved over the floor so as to bring it into position which is convenient for above the floor cleaning in various locations in the home, say of various pieces of furniture, rugs, curtains and the like.

From the foregoing description it will be apparent that there has been provided an improved vacuum cleaner of the convertible type having a lift mechanism which is easy to fabricate and install, and yet provides a sturdy and reliable support on which the vacuum cleaner may be moved readily from one position to another to facilitate cleaning. Variations and modifications in the herein described vacuum cleaner and its lift mechanism, within the scope of the invention, will undoubtedly suggest themselves to those skilled in the art. Accordingly the foregoing description should be taken as illustrative and not in a limiting sense.

I claim:

1. In an upright vacuum cleaner having a nozzle housing movable over a surface over which said cleaner is movable and having forward and rearward ends, a top and a bottom, a brush rotatably mounted in said nozzle housing about an axis extending in a direction across the width of said nozzle housing and in the forward end thereof, said brush extending extending outwardly from the bottom of the nozzle housing, said vacuum cleaner also having a body with a bottom end pivotally mounted within said nozzle housing and rockable in a forward direction toward the forward end of said nozzle housing at least to a position where said body is upright and rearwardly past said upright position toward the rearward end of said nozzle housing, an improved mechanism for lifting the forward end of said housing to raise the forward end sufficiently to bring said brush out of engagement with the surface to be cleaned, which mechanism comprises a stanchion having a base of length at least about half the width of said nozzle housing, said stanchion also having a pair of posts disposed upright on said base and presenting upper ends above said base, said posts being spaced apart along the length of said base, mounting means for said stanchion in said nozzle housing having a pair of holes spaced from each other a distance equal to the spacing of said posts and in which said posts are reciprocably mounted and for locating said posts adjacent to the bottom of said body, a surface of the bottom of said body being engageable with the upper ends of said posts when said body is pivoted forwardly at least to said upright position thereof for reciprocating said stanchion downwardly beyond the bottom of said nozzle housing a sufficient distance to lift the brush above, and disengage said brush from, the surface over which said cleaner is movable.

2. The improved mechanism according to claim 1 further comprising compression springs coiled about said Posts between said mounting means and said upper ends thereof for biasing said stanchion upwardly into said nozzle housing.

3. The improved mechanism according to claim 1 wherein the bottom of said base presents a generally hemi-cylindrical surface to the surface over which said cleaner moves.

4. The improved mechanism according to claim 1 wherein the surface of the bottom of said body is provided by notches into which the upper ends of said posts extend.

5. The mechanism accordingly to claim 1 wherein said nozzle housing has wheels on which said cleaner is movable over said surface journaled in the rearward end of said nozzle housing, said wheels defining with said surface on which said cleaner is movable pivots about which said nozzle tilts when said stanchion is extended when said body is rocked forwardly at least to said upright position.

6. The improved mechanism according to claim 1 wherein said base have a cup shaped trough therein facing downwardly out of the bottom of said nozzle housing a cylindrical roller having an axial length at least about one-third the width of said housing is journaled in said trough and extending partially out of said trough, said roller being disposed with its axis parallel to the axis of said brush.

7. The improved mechanism according to claim 6 wherein said trough has a pin therein extending lengthwise of said roller having a hole through which said pin extended said roller being notchable on said pin.

8. The improved mechanism according to claim 7 wherein said hole is tapered from larger diameters near to ends of said roller to a smaller diameter near the center thereof.

9. The improved mechanism according to claim 1 wherein said nozzle and body have detent means for latching said body in an upright position.

10. The improved mechanism according to claim 9 wherein said detent means is provided by a spring biased ball on said body and a notch on said housing for latchably receiving said ball.

* * * * *